US010029822B2

(12) United States Patent
Kinney et al.

(10) Patent No.: US 10,029,822 B2
(45) Date of Patent: Jul. 24, 2018

(54) LONGITUDINALLY SEGREGATED VESSEL

(71) Applicants: Christina Kinney, San Francisco, CA (US); Kyle McKay, San Francisco, CA (US)

(72) Inventors: Christina Kinney, San Francisco, CA (US); Kyle McKay, San Francisco, CA (US)

( * ) Notice: Subject to any disclaimer, the term of this patent is extended or adjusted under 35 U.S.C. 154(b) by 0 days.

(21) Appl. No.: 15/293,247

(22) Filed: Oct. 13, 2016

(65) Prior Publication Data

US 2017/0341813 A1 Nov. 30, 2017

Related U.S. Application Data

(60) Provisional application No. 62/240,897, filed on Oct. 13, 2015.

(51) Int. Cl.
*B65D 25/06* (2006.01)
*B65D 43/02* (2006.01)

(52) U.S. Cl.
CPC ..... *B65D 25/06* (2013.01); *B65D 43/0225* (2013.01)

(58) Field of Classification Search
CPC ..... B65D 25/06; B65D 25/04; B65D 25/02; B65D 43/0225; B65D 43/0202; B65D 43/0231; B65D 43/02; B65D 1/24; B65D 1/04
USPC .... 220/532, 544, 529, 530, 526, 523; 215/6; 211/184
See application file for complete search history.

(56) References Cited

U.S. PATENT DOCUMENTS

| | | | | |
|---|---|---|---|---|
| 861,815 | A | 7/1907 | Cullen | |
| 948,434 | A * | 2/1910 | Scott | A47G 19/02 220/532 |
| 1,208,189 | A | 12/1916 | Miller | |
| 1,736,264 | A | 11/1929 | Johnson | |
| 1,989,221 | A | 1/1935 | Westwood et al. | |
| 2,073,636 | A | 3/1937 | Holoubek | |
| 2,223,432 | A | 12/1940 | Smith | |
| 2,605,013 | A | 7/1952 | Rubenstein | |
| 2,626,079 | A * | 1/1953 | Keller | B65D 1/243 217/36 |
| 2,898,010 | A | 8/1959 | Tepper | |
| 3,052,368 | A | 9/1962 | Atkins et al. | |
| 3,144,152 | A | 8/1964 | Herman | |
| 3,311,264 | A | 3/1967 | Cayer | |
| 3,394,861 | A | 7/1968 | Traux | |
| 4,078,686 | A | 3/1978 | Karesh | |

(Continued)

FOREIGN PATENT DOCUMENTS

CN 202287992 U 7/2012

*Primary Examiner* — Robert J Hicks
(74) *Attorney, Agent, or Firm* — NWAMU, P.C.

(57) ABSTRACT

A longitudinally segregated vessel segregates items into longitudinal compartments, and allows rotational manipulation of the items. A bottom wall and the continuous sidewall form a cavity to receive the items. A longitudinal divider is removably placeable in the cavity of the cylindrical container. The longitudinal divider includes a central axis having a top end and a bottom end. The top end includes a disc that serves as a grip to rotate or axially displace the longitudinal divider in the container. The longitudinal divider includes a plurality of partitions that extend radially outward of the central axis to segregate the items in the container into longitudinal compartments.

17 Claims, 4 Drawing Sheets

(56) References Cited

U.S. PATENT DOCUMENTS

| | | | | |
|---|---|---|---|---|
| 4,429,805 | A * | 2/1984 | Letica | B65D 1/22 220/675 |
| 5,232,108 | A | 8/1993 | Nakamura | |
| 5,540,329 | A * | 7/1996 | Vogeley | B25H 3/00 206/373 |
| 5,806,708 | A * | 9/1998 | Schwab | A45C 11/008 220/378 |
| 6,092,717 | A | 7/2000 | Lowry | |
| 6,196,412 | B1 | 3/2001 | Cattell | |
| 6,296,885 | B1 | 10/2001 | Robertson | |
| 6,415,940 | B1 | 7/2002 | Hobert | |
| 6,450,351 | B1 | 9/2002 | Thompson | |
| 7,571,829 | B2 | 8/2009 | Gersovitz | |
| 8,887,968 | B1 | 11/2014 | Call | |
| 8,915,395 | B2 | 12/2014 | Gersovitz | |
| 2002/0096525 | A1* | 7/2002 | Bertoldo | B44D 3/122 220/544 |
| 2002/0139804 | A1 | 10/2002 | Greiner | |
| 2002/0150854 | A1 | 10/2002 | Riches | |
| 2009/0250368 | A1 | 10/2009 | Earl et al. | |
| 2016/0060004 | A1* | 3/2016 | Dunn | A47G 19/02 222/144.5 |

* cited by examiner

LONGITUDINALLY SEGREGATED VESSEL

CROSS REFERENCE OF RELATED APPLICATIONS

This application claims the benefits of U.S. Provisional Application No. 62/240,897, filed Oct. 13, 2015 and entitled "An Insert for Use in Jar-Type Containers Allowing Contents Within to be Separated Vertically," which is hereby incorporated by reference in its entirety as if fully set forth herein.

BACKGROUND

The present disclosure relates generally to container apparatuses, systems and methods and more specifically to container apparatuses, systems and methods for segregating stored items.

Containers include a vessel that creates a partially or fully enclosed space that can be used to contain, store, and transport objects or materials. Items stored inside of a container are protected by structure of the container. Containers might be made of polymeric or other metallic materials such as aluminum, etc.

It is within the aforementioned context that a need for the present disclosure has arisen. Thus, there is a need to address one or more disadvantages of conventional systems and methods, and the present disclosure meets this need.

BRIEF SUMMARY

Various aspects of a segregated vessel can be found in exemplary embodiments of the present disclosure.

In one embodiment, the interior of the segregated vessel is segregated longitudinally. Thus, the longitudinally segregated vessel can receive and store a plurality of items inside longitudinal compartments while enabling rotational manipulation of the stored items.

In an embodiment, the longitudinally segregated vessel provides a container having a bottom wall and a continuous sidewall extending from the bottom wall and terminating at an opening. The bottom wall and the continuous sidewall form a cavity that is sized and dimensioned to receive a plurality of segregated items.

In another embodiment, the longitudinally segregated vessel provides a longitudinal divider. In another embodiment, a disc that is disposed generally perpendicular to a central axis might be attached to the disc to rotate or assist removal of the longitudinal divider from the container.

A further understanding of the nature and advantages of the present disclosure herein may be realized by reference to the remaining portions of the specification and the attached drawings. Further features and advantages of the present disclosure, as well as the structure and operation of various embodiments of the present disclosure, are described in detail below with respect to the accompanying drawings. In the drawings, the same reference numbers indicate identical or functionally similar elements.

DETAILED DESCRIPTION

Reference will now be made in detail to the embodiments of the disclosure, examples of which are illustrated in the accompanying drawings. While the disclosure will be described in conjunction with the preferred embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth to provide a thorough understanding of the present disclosure. However, it will be obvious to one of ordinary skill in the art that the present disclosure may be practiced without these specific details. In other instances, well-known methods, procedures, components, and circuits have not been described in detail as to not unnecessarily obscure aspects of the present disclosure.

Figure 1:
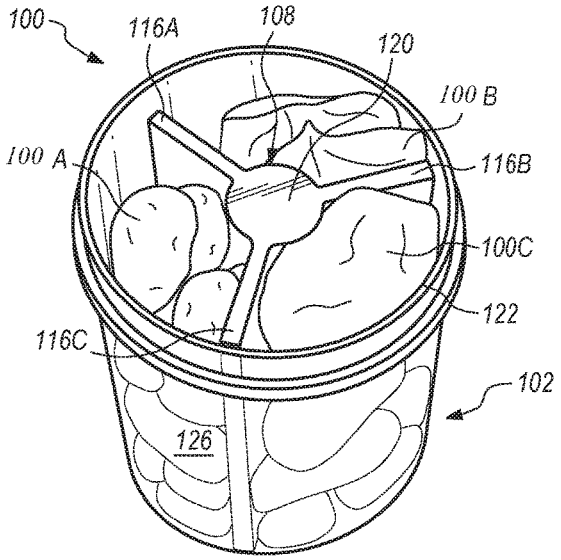
FIG. 1 illustrates a top angle perspective view of a longitudinally segregated vessel according to an exemplary embodiment of the present disclosure.

FIG. 1 illustrates a top angle perspective view of a longitudinally segregated vessel 100 according to an exemplary embodiment of the present invention.

In FIG. 1, a user might utilize segregated vessel 100 to segregate items 100A, 100B, 100C into three separate longitudinal compartments within a cavity of a container 102. As further illustrated in FIGS. 2 and 3, segregated vessel 100 can be used to segregate any number of item types including but not limited to silverware and granular seeds.

Referring to FIG. 1, for example, longitudinally segregated vessel 100 receives and may store sliced tomatoes 100A, spinach 100B and cheese portions 100C in the container 102. Upon placing items 100A, 100B and 1000 in container 102, longitudinally segregated vessel 100 segregates the items into longitudinal compartments in the container 102. Further, longitudinally segregated vessel 100 enables rotational manipulation of items while the items are segregated in container 102.

Figure 2:
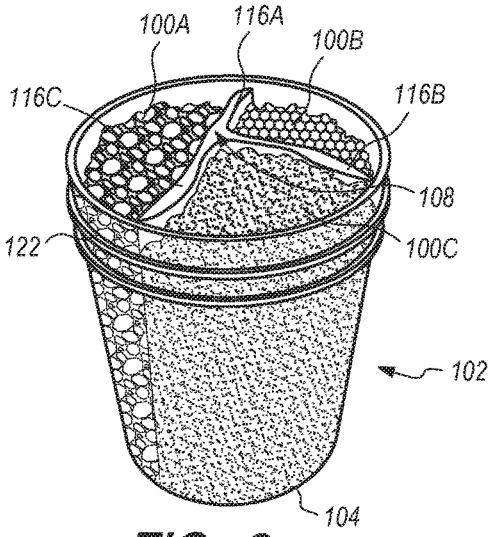
FIG. 2 illustrates a further top angle perspective view of a longitudinally segregated vessel according to an exemplary embodiment of the present disclosure.
Figure 3:
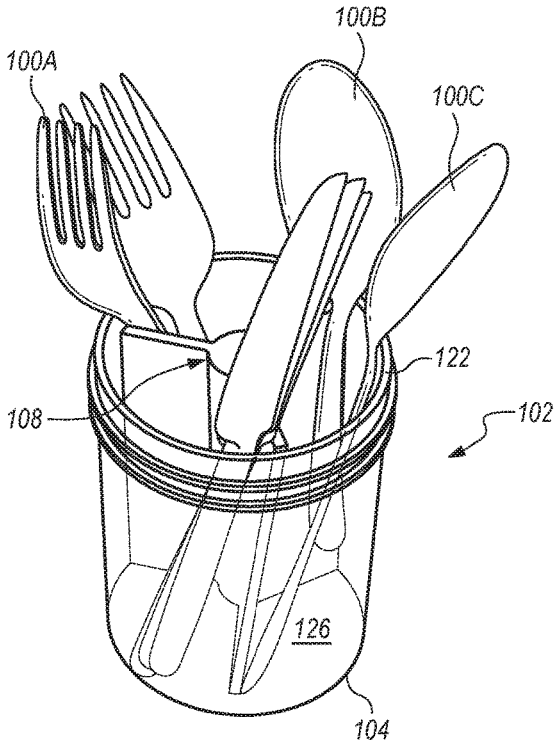
FIG. 3 illustrates a top angle perspective view of a longitudinally segregated vessel according to an exemplary embodiment of the present disclosure.

This segregation can be effective for grouping and classifying items to facilitate access and distribution thereof. Items 100A, 100B, 100C contained and segregated by the longitudinally segregated vessel 100 may include, without limitation food items, granular items, vegetable, currency, gel and liquids. As an example, FIG. 2 shows granular food items segregated by color, consistency, and size. FIG. 3 shows segregation of elongated silverware into different longitudinal compartments. In this arrangement, forks can be placed in one compartment, knives can be placed in a second compartment, and spoons can be placed in a third compartment.

Figure 4:
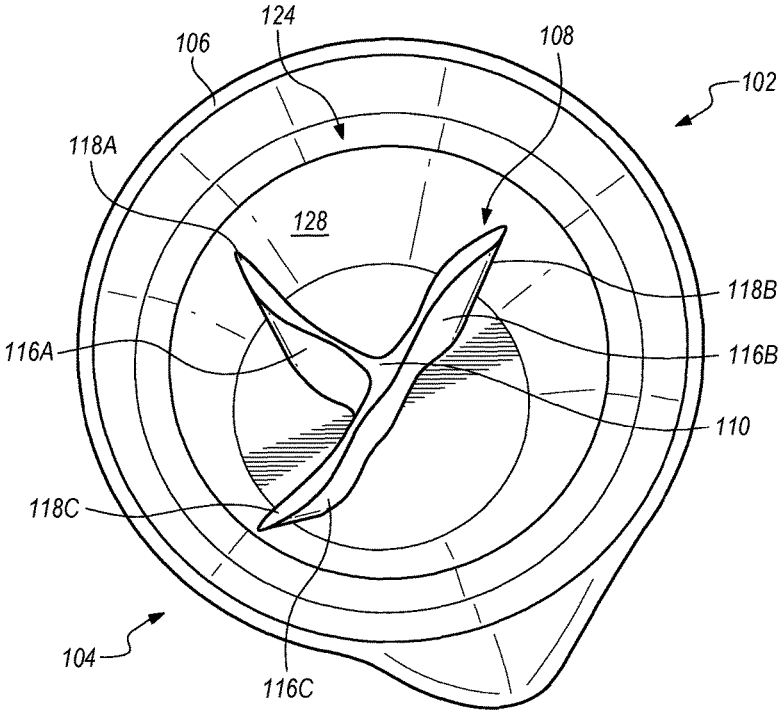
FIG. 4 illustrates a top view of a glass, cylindrical container with a longitudinal divider disposed longitudinally in the container according to an exemplary embodiment of the present disclosure.

FIG. 4 illustrates a top view of a glass, cylindrical container with a longitudinal divider 108 disposed longitudinally in the container 102.

Here, container 102 may be generally cylindrical. In other embodiments, container 102 may be rectangular shape or other shapes consistent with the scope and spirit of the present invention.

Referring to FIGS. 3 and 4, container 102 includes a continuous sidewall 106 extending from bottom wall 104 and terminating at an opening. A threaded or tapered neck 122 may form around the opening. Bottom wall 104 and continuous sidewall 106 of container 102 form a cavity 124 that is sized and dimensioned to receive at least one item 100A, 100B, 100C. The opening is sufficiently sized to enable passage of myriad items.

The continuous sidewall 106 of container has an outer surface 126 and an inner surface 128. Outer surface 126 provides a smooth or textured surface for gripping and manipulating container 102. Inner surface 128 may include a plurality of grooves 130A, 130B, 1300 disposed longitudinally along the length of container 102 for creating a liquid seal in each compartment, as described below and in FIG. 11.

Any size of container 102 may be used, as the longitudinal segregated vessel 100 is scalable. Container 102 may receive and store foodstuff, spices, dried food products, granular members, elongated instruments, liquids, medications, personal items, hardware, travel items and the like. Suitable materials for the container 102 may include, without limitation, glass, polyethylene, polyurethane, polyvinylchloride, a rigid polymer, metal, wood, and silicone.

Figure 5:
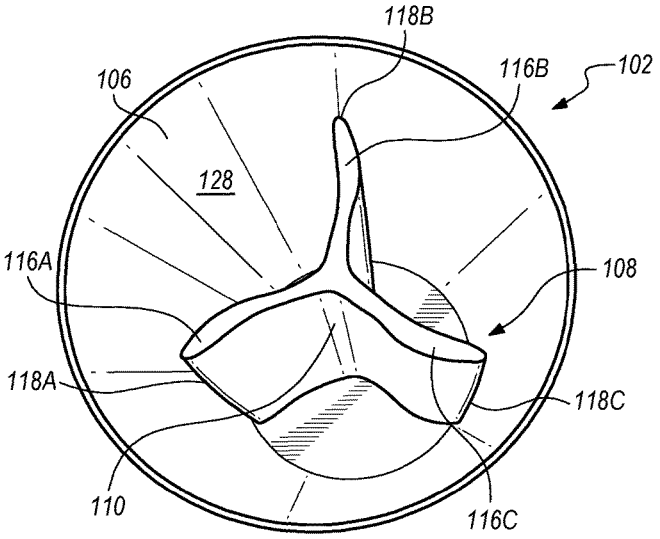
FIG. 5 illustrates a top view of a polymeric cylindrical container with a longitudinal divider disposed longitudinally therein according to an exemplary embodiment of the present disclosure.

As referenced in FIGS. 4 and 5, various shapes and material compositions can be used for the container 102. For example, the glass container shown in FIG. 4 may be effective for microwaving the contained items 100A, 100B, 100C. The plastic container shown in FIG. 5 may be more efficient for storage because of the compressibility of plastic material. Also, the longitudinal divider 108 in FIG. 5 is curved and/or undulating.

The formed opening in the container 102 provides an inlet that can be covered by a lid to regulate access to the segregated items 100A, 100B, 100C in the cavity. The interior of the lid may have a thread to make with a threaded or tapered neck 122 of container 122. Though in other embodiments, a tight relationship exists between the lid and a longitudinal divider 108. The relationship may be due to a disc positioned on the longitudinal divider 108 that removably adheres to the underside of the lid.

As further described below, container 102 may include variations of longitudinal divider 108. For example, longitudinal divider 108 of FIG. 3 includes dividers having sides that are separated from each other by approximately 120 degrees. However, in FIG. 4, two divider sides are separated by 180 degrees while an oppositely disposed divider is at approximately 90 degrees from adjacent dividers. The undulating nature of the dividers can also facilitate easy rotation or segregation of items therein.

Figure 6:
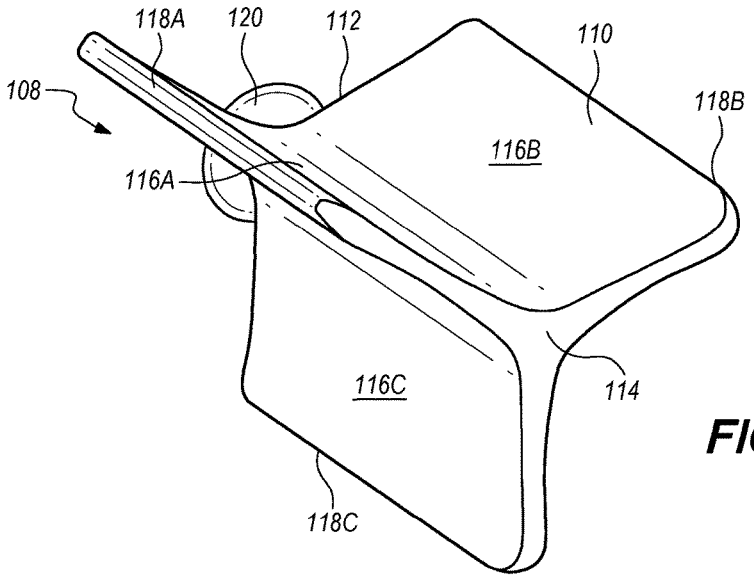
FIG. 6 illustrates a perspective view of a bottom end of the longitudinal divider according to an exemplary embodiment of the present disclosure.
Figure 7:
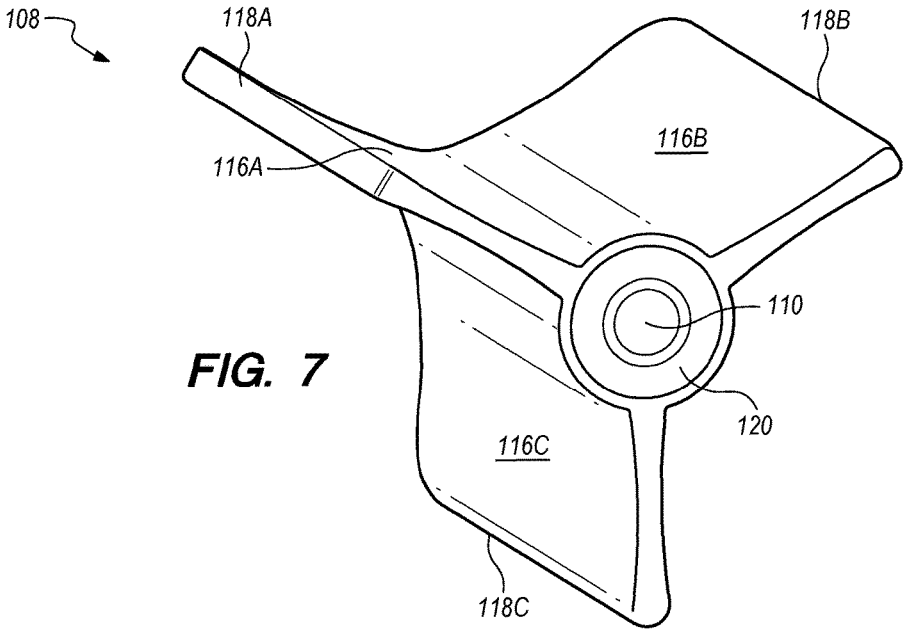
FIG. 7 illustrates a perspective view of a top end of the longitudinal divider shown in FIG. 6 according to an exemplary embodiment of the present disclosure.

FIGS. 6 and 7 illustrates bottom and top perspective views of a longitudinal divider 108.

Longitudinally segregated vessel 100 provides a longitudinal divider 108 that fits inside the container 102, and serves to segregate the items 100A, 100B, 100C. Longitudinal divider 108 includes a central axis 110 and a plurality of partitions 116A, 116B, 116C extending outward radially from the central axis 110.

The radial partitions 116A, 116B, 116C may be dimensioned to be about half the length of the central axis 110. Suitable materials for longitudinal divider 108 may include, without limitation, glass, polyethylene, polyurethane, polyvinylchloride, a rigid polymer, metal, wood, and silicone.

Longitudinal divider 108 is removably placeable in the cavity 124 of the cylindrical container 102. The longitudinal divider 108 is generally light weight and easily manipulated with one hand. Longitudinal divider 108 positions generally concentric and longitudinal to the container 102. Longitudinal divider 108 is generally about the length of the sidewall 106, so as not to protrude but yet provide a secure abutment with the lid. opening.

The longitudinal divider 108 includes a central axis 110 having a top end 112 and a bottom end 114. When the longitudinal divider 108 is placed in the container 102, the top end 112 of the central axis 110 orients towards the opening in the container 102. Conversely, the bottom end 114 of the central axis 110 orients towards the bottom wall 104 of the container 102.

Figure 8:
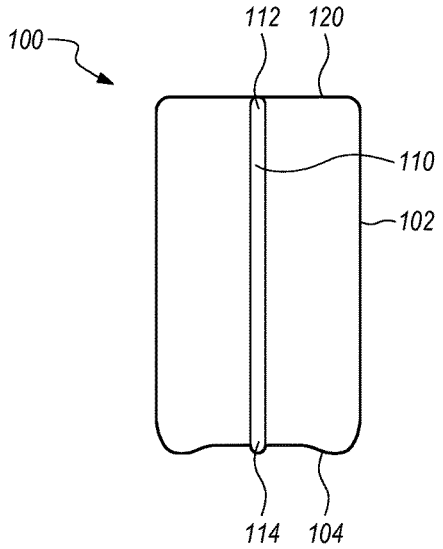
FIG. 8 illustrates a cross sectional side view of a longitudinal divider having a central axis with a disc according to an exemplary embodiment of the present disclosure.

As illustrated in FIG. 8, the top end 112 of the central axis 110 includes a disc 120 that is disposed generally perpendicular to the top end 112 of the central axis 110. Disc 120 is generally flat and extends circumferentially from the top end 112 of the axis 110. Disc 120 may have a generally circular shape. Though in some embodiments, disc 120 can have a square or triangular shape while providing the same function as the circular shape.

Figure 9:
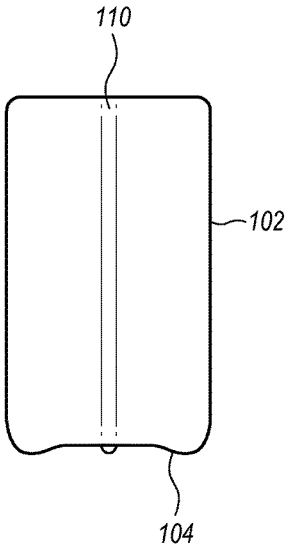
FIG. 9 illustrates a cross sectional side view of a container with a longitudinal divider having a central axis with no disc according to an exemplary embodiment of the present disclosure.

FIG. 9 illustrates a sectioned side view of a container 102 with a central axis 110. The disc 120 at the top end 112 of central axis 110 is useful for providing a grip to rotate or axially displace the longitudinal divider 108 in container 102. Disc 120 may also facilitate removal and placement of longitudinal divider 108 in container 102. The disc 120 also has sufficient width and circumferential area to form a spacer against the lid covering the opening.

Figure 10:
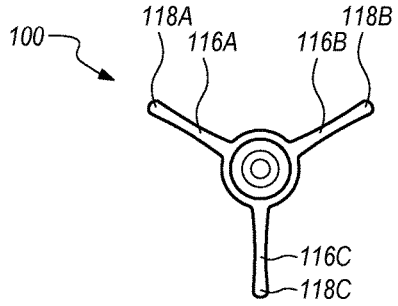
FIG. 10 illustrates a top view of a longitudinal divider according to an exemplary embodiment of the present disclosure.

FIG. 10 illustrates a top view of a plurality of partitions 116A, 116B, 116C that extend radially outward of the central axis 110.

The longitudinal divider 108 includes a plurality of partitions 116A, 116B, 116C that extend radially outward of the central axis 110. Partitions 116A, 116B, 116C form the barriers that segregate the items 100A, 100B, 100C in the container 102 into individual, longitudinal compartments. Partitions 116A, 116B, 116C extend substantially the entire length of the central axis 110 so as to maximize surface area against the items 100A, 100B, 100C. In this manner, items 100A, 100B, 100C placed in the cavity of the container 102 may be segregated longitudinally along the length of the container 102.

As illustrated in FIGS. 4 and 5, the partitions 116A, 116B, 1160 may include three partitions 116A, 116B, 116C arranged in an equally spaced-apart radial relationship.

However in other embodiments, two, four, or more partitions may extend radially form the central axis 110. Partitions 116A, 116B, 116C may be equally spaced from each other. For example, three partitions 116A, 116B, 116C are 120° apart around the central axis 110. However in alternative embodiments, the partitions may have uneven spacing between each other.

Partitions 116A, 116B, 1160 may have a generally flat, rectangular shape, or an undulating shape. In some embodiments, a portion of the partitions 116A, 116B, 116C may be flat, and a portion may be undulating. However in other variations, any number and variety of dimensions, shapes, and arrangements are possible with the partitions.

Partitions 116A, 116B, 1160 are defined by an outer edge 118A, 118B, 118C that forms a continuous surface area with the sidewall 106 of container 102. Outer edge 118A, 118B, 118C may form a seal with the sidewall 106, so as to restrict passage of gels or fluids between the formed compartments. Outer edge 118A, 118B, 118C may be more flexible than the interior regions of the partition to facilitate rotation of longitudinal divider 108 within container 102.

In instances where the divider 108 is fabricated from silicone; the width of the radial partition 116A, 116B, 116C may be such that it is longer than the internal radius of the container 102 to promote tightness between the interior face of the sidewall 106 of the container and the silicone radial divider In operation of the longitudinally segregated vessel 100, the container 102 is positioned with bottom wall 104 resting on a smooth surface and the opening exposed to receive at least one item 100A, 100B, 100C. Longitudinal divider 108 is placed, generally concentrically in the cavity of the container 102, with the top end 112 with the disc 120 oriented towards the opening of the container 102.

Partitions 116A, 116B, 116C are checked to ensure a flush engagement with the sidewall 106 of the container 102. In this manner, different items are restricted from mixing. Disc 120 may be rotated or axially displaced to achieve a desired angular and axial position for the longitudinal divider 108.

At this point, multiple longitudinal compartments are formed in the container 102. Each item 100A, 100B, 100C is placed into a separate longitudinal compartment. However in other possible arrangements, different items, or the same items may be segregated in this manner, as desired. Finally, a lid is placed over the opening. Disc 120 should provide sufficient spacing for the lid, or rest flush against the lid, so as to enable the lid to fully close over the opening in container 102.

Figure 11:
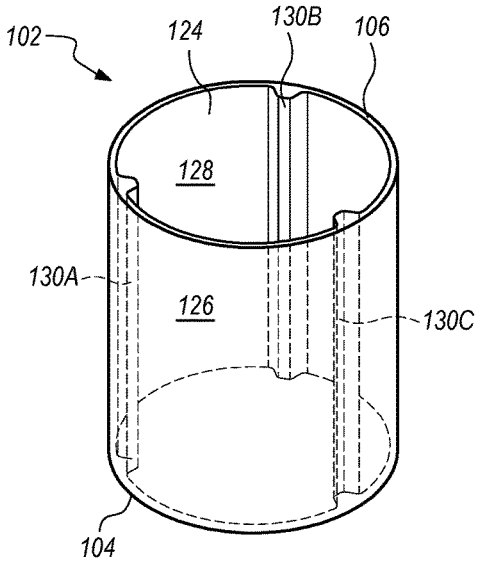
FIG. 11 illustrates a perspective view of a container having a plurality of grooves disposed longitudinally along an inner surface of the sidewall according to an exemplary embodiment of the present disclosure.

FIG. 11 illustrates a perspective view of a container 102 having a plurality of grooves 130A, 130B, 130C disposed longitudinally along the inner surface 128 of the sidewall 106.

Grooves 130A, 130B, 130C may be disposed longitudinally along the entire length, or a portion of the length of the inner surface 128 of the sidewall 106. Grooves 130A, 130B, 130C may be configured to align with the spacing and number of partitions 116A, 116B, 116C. Grooves 130A, 130B, 130C enable the partitions 116A, 116B, 116C to create a liquid proof seal between the outer edges 118A, 118B, 118C and the inner surface 128 of continuous sidewall 106.

The outer edge 118A, 118B, 118C of partitions 116A, 116B, 116C slidably engage corresponding grooves 130A, 130B, 130C to form a liquid proof seal at the junction between the outer edge 118A, 118B, 118C and the inner surface 128 of the sidewall 106. Grooves 130A, 130B, 130C also work to inhibit slippage and undesirable rotation of the partition while in the cavity 124 of container 102.

While the above is a complete description of exemplary specific embodiments of the disclosure, additional embodiments are also possible. Thus, the above description should not be taken as limiting the scope of the disclosure, which is defined by the appended claims along with their full scope of equivalents.

We claim:

1. A longitudinally segregated vessel comprising:

a generally cylindrical container comprising a bottom wall and a continuous sidewall extending from the bottom wall and terminating at an opening, the bottom wall and the continuous sidewall defined by a cavity having an outer surface and an inner surface, the inner surface being continuously smooth; and a longitudinal divider separating different solid articles that are stored in the generally cylindrical container, the longitudinal divider comprising a central axis having a top end and a bottom end, the longitudinal divider further comprising a plurality of partitions extending radially outward of the central axis, each of the plurality of partitions defined by a varying thickness, wherein said varying thickness is that a thickness at the middle of each partition is thinner than at a beginning and at an end of the partition, wherein said top end comprises a handle, the handle being disc-shaped and being disposed generally perpendicular to the central axis, the diameter of the handle extending the handle beyond the central axis and partially above the plurality of partitions, forming a graspable surface used by a user to firmly grip the longitudinal divider to remove the longitudinal divider and to insert the longitudinal divider into the generally cylindrical container, wherein a radius of each partition of the longitudinal divider is generally about the same as the radius of the generally cylindrical container so that an outer edge of the plurality of partitions is in contact with the sidewall of the cylindrical container and the longitudinal divider is easily rotatable within continuously smooth inner surface of the cavity of the generally cylindrical container.

2. The container of claim 1, wherein the disc of the central axis is configured to enable rotational and axial displacement of the longitudinal divider.

3. The container of claim 1, wherein the plurality of partitions comprises three partitions in a radial, spaced-apart relationship.

4. The container of claim 1, wherein the top end of the central axis is oriented towards the opening in the container.

5. The container of claim 1, further comprising a lid configured to cover the opening in the container.

6. The container of claim 1, wherein the continuous sidewall comprises an inner surface having a plurality of grooves extending longitudinally along the container, whereby the outer edge of the plurality of partitions slidably engage the plurality of grooves.

7. A longitudinally segregated vessel comprising:

a container comprising a bottom wall and a continuous sidewall extending from the bottom wall and terminating at an opening, the bottom wall and the continuous sidewall defined by a cavity, the interior of which has a continuously smooth wall; and a longitudinal divider removably place-able in the cavity of the container, the longitudinal divider comprising a central axis, the longitudinal divider further comprising a plurality of partitions extending radially outward of the central axis, the plurality of partitions defined by an outer edge, each of the plurality of partitions defined by a varying thickness, wherein said varying thickness is so that a thickness at the middle of each partition is thinner that at a beginning and an end of the partition, wherein said longitudinal divider includes a handle at a top end forming a graspable surface used by a user to firmly grip the longitudinal divider to remove the longitudinal divider from the container or to insert the longitudinal divider into the container;

whereby the outer edge of the plurality of partitions is in contact with the continuously smooth wall of the interior of the cavity.

8. The container of claim 7, wherein container comprises a cylindrical container.

9. The container of claim 7, wherein the central axis is defined by the top end and a bottom end.

10. The container of claim 9, wherein the top end comprises a disc disposed generally perpendicular to the central axis.

11. The container of claim 10, wherein the disc of the central axis is configured to enable rotational and axial displacement of the longitudinal divider.

12. The container of claim 7, wherein the plurality of partitions comprises three or more partitions.

13. The container of claim 7, wherein the top end of the central axis is oriented towards the opening in the container.

14. The container of claim 7, further comprising a lid configured to cover the opening in the container.

15. The container of claim 7, wherein the container is configured to store a plurality of items.

16. A longitudinal divider for insertion and removal into a mason jar, the longitudinal divider comprising:

a plurality of partitions separating different solid articles that are stored in the mason jar, the plurality of partitions extending radially outward from a central axis, each of the plurality of partitions defined by a varying thickness of the longitudinal divider, wherein said varying thickness is defined by a thickness at the middle of each partition that is thinner than at a beginning and at an end of the partition, wherein said the top end comprises a handle, the handle being disc-shaped and being disposed generally perpendicular to the central axis, the diameter of the handle extending the handle beyond the central axis and partially above the plurality of partitions, forming a graspable surface used by a user to firmly grip the longitudinal divider for inserting and removing the longitudinal divider into and from the mason jar.

17. The longitudinal divider of claim 16 further comprising a leg on each of the plurality of partitions, the leg extending downward from a corner portion of a base of each partition, the leg in conformance with a curved interior bottom of the mason jar.

* * * * *